United States Patent [19]

Mathers

[11] Patent Number: 4,880,357

[45] Date of Patent: Nov. 14, 1989

[54] METHOD AND APPARATUS FOR PRODUCING HIGH VACUUM

[76] Inventor: Terrence L. Mathers, 7301 Plum St., New Orleans, La. 70118

[21] Appl. No.: 211,884

[22] Filed: Jun. 27, 1988

[51] Int. Cl.[4] ..... F04B 23/14

[52] U.S. Cl. ..... 417/77; 417/158

[58] Field of Search ..... 417/76, 77, 79, 87, 417/152, 153, 154, 158, 198, 174

[56] References Cited

U.S. PATENT DOCUMENTS

| | | | |
|---|---|---|---|
| 246,149 | 8/1881 | Kind | 417/151 |
| 929,674 | 8/1909 | Koerting | 417/198 |
| 1,367,865 | 2/1921 | Crawford | 417/54 |
| 1,791,292 | 2/1931 | Smith | 417/151 |
| 1,791,513 | 2/1931 | Slocum | 417/151 |
| 2,085,361 | 6/1937 | Hellmer | 230/95 |
| 2,183,623 | 12/1939 | Ross | 230/95 |
| 2,375,180 | 5/1945 | Vigo | 417/151 |
| 2,452,421 | 10/1948 | Ames | 417/77 |
| 3,064,878 | 11/1962 | Bayles et al. | 230/45 |
| 3,315,879 | 4/1967 | Jennings | 417/87 |
| 3,369,735 | 2/1968 | Hoffmeister | 230/95 |
| 3,545,886 | 10/1970 | Chalom | 417/151 |
| 3,551,074 | 12/1970 | Stout | 417/198 |
| 3,830,064 | 8/1974 | Bronicki | 60/667 |
| 4,505,645 | 3/1985 | Laguilharre | 417/77 |
| 4,580,948 | 4/1986 | Schmidlin | 417/54 |
| 4,632,649 | 12/1986 | Segebrecht et al. | 417/151 |

*Primary Examiner*—Carlton R. Croyle
*Assistant Examiner*—Robert N. Blackmon
*Attorney, Agent, or Firm*—David L. Ray

[57] ABSTRACT

A method and apparatus for obtaining sub-atmospheric pressures including a venturi tube having a first end and a second end, a nozzle located in the first end of the venturi tube for spraying fluids, a collection chamber connected to the second end of the venturi tube for receiving fluids sprayed from the nozzle, a vacuum chamber connected to the first end of the venturi tube, an outlet connected to the collection chamber for removing fluids from the collection chamber, and a pump connected to the outlet for pumping fluids from the outlet to the nozzle.

18 Claims, 1 Drawing Sheet

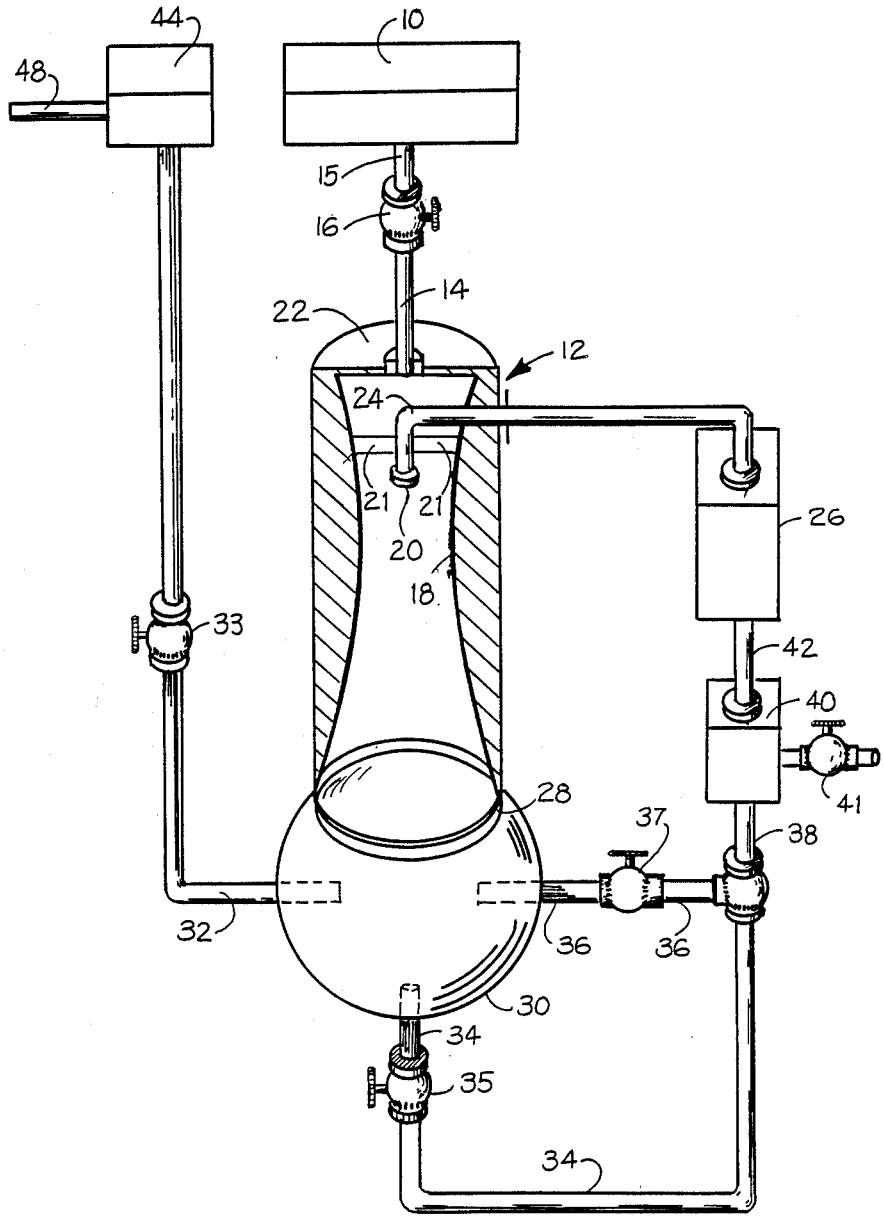
44
10
48
15
16
14
22
12
24
21
21
20
18
26
33
42
40
41
28
37
38
32
36
36
30
34
35
34

METHOD AND APPARATUS FOR PRODUCING HIGH VACUUM

BACKGROUND OF THE INVENTION

1. Field of the Invention

The present invention is related to method and apparatus for producing a vacuum. More particularly, the present invention relates to method and apparatus for producing a vacuum employing a nozzle and venturi combination for achieving sub-atmospheric pressures.

2. Brief Description of the Prior Art

Two basic methods of vacuum production are momentum transfer between a working fluid or turbine and a gas being evacuated and trapping of a gas to be evacuated. Momentum transfer is commonly achieved by utilization of jet pumps, turbines, aspirators and diffusion pumps. Gas trapping is achieved by mechanical pumps, cryogenic pumps, and ion pumps.

Commonly, a distinction is made between pumps designed for primary pumping or secondary pumping. Primary pumps are utilized for higher pressure than secondary pumps and their pumping processes become inefficient at lower pressures. Secondary pumps are utilized at very low pressure and usually can not be operated at a pressure higher than one millimeter of mercury or less.

Exemplary of the prior art are the following U.S. Patents:

U.S. Pat. No. 4,632,649 discloses a gas jet pump having a housing and mixing nozzle holder which form a mounting for a mixing nozzle. The pump is used in both the sub-atmospheric range as a backing pump for other vacuum pumps and in the above atmospheric range.

U.S. Pat. No. 4,580,948 discloses a hydrokinetic amplifier with a high momentum transfer co-efficient discloses a hydrokinetic amplifier configured to receive liquid and vapor for condensing the vapor in the liquid, transferring momentum from the vapor to the liquid, and increasing the pressure of the liquid substantially from input to output. The hydrokinetic amplifier includes an acceleration chamber, a diffuser, a vapor nozzle, an annular liquid nozzle and an annular outer vapor nozzle surrounding the liquid nozzle.

U.S. Pat. No. 3,830,064 discloses an injector for furnishing liquid at a low pressure to a vessel at a higher pressure including an enclosed chamber which has at its bottom end a centrally located downwardly converging combining tube, a nozzle centrally supported in the chamber having a downwardly and outwardly directed tube extending through the central opening and terminating in the lower chamber, and a diverging diffuser tube connected to the outlet of the combining tube for slowing the stream and converting its velocity to a pressure head.

U.S. Pat. No. 3,369,735 discloses a gas jet suction device for connection to vacuum pump having an injector unit formed of a mixing tube and a jet nozzle located in the mixing tube, the injector being mounted in the housing structure, the jet nozzle being coaxially seated in the neck portion of the apparatus for driving a gas jet through a tube toward the outlet neck portion.

U.S. Pat. No. 3,064,878 discloses a method and apparatus for producing a vacuum employing a supersonic jet diffuser having a convergent mixing entrance, a turbulence reducing or constant area duct and a diffuser portion having characteristics and being so proportioned as to provide optimum efficiency of fluid flow therethrough upon predetermined pressure conditions of primary and secondary inlet areas.

U.S. Pat. No. 2,183,623 discloses a steam injector, discloses steam jet exhauster which will withstand erosive action of wet steam and the corrosive action of acid and other chemical vapors and fluids. The steam injector includes a nozzle for spraying steam into a vitreous diffuser or venturi.

U.S. Pat. No. 2,085,361 discloses a steam jet exhauster having a nozzle made of carbon for spraying steam located above a diffuser or venturi made from carbon. The carbon resists the erosive action of wet steam and the corrosive of action vapors.

U.S. Pat. No. 1,367,865 discloses a method and apparatus for producing a high vacuum including entraining the gas to be pumped in a jet vapor such as mercury, cadmium, hydrocarbon oils, or the like which has a extremely high velocity and high degree of rarefaction due to having been expanded from a high initial pressure to a considerable lower pressure. The degree of expansion of the jet is such that a specially absorptive condition of the jet is produced enabling the jet to entrain gas whose pressure is only a small fraction of the pressure in the jet.

U.S. Pat. No. 929,674 discloses a water jet apparatus which serves as the propulsive or actuating means in aspirators, exhausters, jet-condensers and similar apparatus. The water jet apparatus includes ribs or grooves in the water jet or jets to break up the outer skin of the jet so that it issues from the orifice in a form of an envelope of separated and partly scattered water particles surrounding an interior solid and compact core.

U.S. Pat. No. 246,149 discloses a hydraulic ventilator utilizing a nozzle discharging water into a cylinder producing a pressure differential at each end of the cylinder. The pressure differential is utilized to propel air through a building or dwelling to purify, moisturize and cool the air.

SUMMARY OF THE INVENTION

In accordance with the present invention there is provided a method and apparatus for obtaining sub-atmospheric pressures including a venturi tube having a first end and a second end, a nozzle located in the first end of the venturi tube for spraying fluids, a collection chamber connected to the second end of the venturi tube for receiving fluids sprayed from the nozzle, a vacuum chamber connected to the first end of the venturi tube, an outlet connected to the collection chamber for removing fluids from the collection chamber, and a pump connected to the outlet for pumping fluids from the outlet to the nozzle.

The present invention may be utilized for both primary or secondary pumping and utilizes both momentum transfer and gas trapping to establish a pressure differential between the vacuum chamber and the collection chamber. The nozzle is provided with a fluid at high pressure which atomizes into droplets after being sprayed or expelled from the nozzle. The fluid may be a conventional pumping medium such as pump oil commonly used in conventional diffusion pumps.

The droplets formed by the nozzle travel through the venturi and either transfer momentum to gas molecules contained in the first end of the venturi tube and thereby entrain or absorb them. The droplets proceed into the collecting chamber and strike the wall of the collection chamber. Upon striking the wall of the collection chamber most of the gas dissolved in the droplets is forced out of the oil due to the vibration of the droplet caused by impact with the walls of the collection chamber. Gas molecules to which momentum has been transferred are effectively entrained in the fluid sprayed from the nozzle and carried into the collection chamber.

The venturi tube is utilized to increase the efficiency of the entrainment of the fluid being evacuated from the vacuum chamber. Preferably the collection chamber has several outlets for removal of fluids collected in the chamber. By providing several inlets spaced apart on the collection chamber, the apparatus can be operated in various positions as needed when the position of the apparatus is changed. An outlet which is covered by liquid in the collection chamber is the outlet connected to the pump.

The liquids may have some gas molecules still dissolved therein. Preferably a gas oil separator and oil cleaner is connected to the outlet line or lines to remove the remaining gas molecules or other impurities dissolved in the working liquid being recirculated to the nozzle. The gas oil separator could be omitted if desired, or placed downstream from the pump.

BRIEF DESCRIPTION OF THE DRAWING

The invention will be more fully understood by reference to the drawing which is a schematic representation of the invention.

DESCRIPTION OF THE PREFERRED EMBODIMENTS

Referring now to the drawing, there is shown a vacuum chamber generally indicated by the numeral 10. The vacuum chamber 10 is any space or chamber which is desired to be evacuated or reduced to sub-atmospheric pressure or in which it is desired to create an air flow. Vacuum chamber 10 is connected to venturi chamber 12 by pipe 14, valve 16, and pipe 15. Venturi chamber 12 has a venturi 18 located therein. A nozzle 20 is located in venturi 18 near the top end 22 of venturi 18. Nozzle 20 preferably has supports 21 connected thereto and to venturi chamber 12. Nozzle 20 has pipe 24 connected thereto which is in turn connected to pump 26, which is connected to gas-oil separator 40 by pipe 42. Pump 26 is preferably a high speed pump capable of delivering a high flow of fluids to nozzle 20 under high pressure.

Connected by a conventional method to the lower end 28 of venturi 18 is collection chamber 30. Collection chamber 30 is preferably generally spherical in shape and has a plurality of outlets 34 and 36 connected thereto with valves 35 and 37 located in the outlets.

Outlets 34 and 36 are used to remove liquids from collection chamber 30. The outlets are spaced at convenient locations on collection chamber 30 so that the collection chamber 30 and venturi chamber 12 may be rotated through a range of positions. For example, collecting chamber 30 and venturi chamber 12 may be rotated as much as 900° degrees and liquid contained in the collection chamber will cover one of the outlets. Furthermore, with additional outlets, rotation of up to 1800° is possible at high fluid velocities. Only the outlet which is covered by liquid is opened and the other outlets are closed.

Outlets 34 and 36 are connected to pipe 38. Pipe 38 is preferably connected to a conventional gas-liquid separator and liquid cleaner 40. Gas-liquid separators and liquid cleaners are well known in the art. A typical gas-liquid separator is combined with a filter for liquids to become a gas-liquid separator and liquid cleaner. Gas-liquid separator 40 is connected to liquid pump 26 by pipe 442. If desired, gas-liquid separator 40 may be omitted, and pipe 38 could be connected directly to pump 26. Gas removed from the fluids entering separator 40 may be vented to the atmosphere or any desired reservoir through valve 41.

Outlet 32 may be connected through valve 33 to primary vacuum pump 44 when the apparatus of the invention is used as a secondary vacuum pump. Primary vacuum pump 44 is connected to collection chamber 30 and venturi chamber 12 by opening valve 33, and to vacuum chamber 10 by opening valve 16. Vacuum pump 44 has a discharge line 48 leading to the atmosphere or other reservoir (not shown). Vacuum pump 44 may be any conventional vacuum pump such as a positive displacement pump, a centrifugal pump, a diffusion pump system, or the like.

Thus primary vacuum pump 44 may be employed to initially evacuate vacuum chamber 10 and collection chamber 30 to sub-atmospheric pressure. Liquid pump 26, venturi chamber 12, and collection chamber 30 are utilized to further drop the pressure within the vacuum chamber 10. Primary vacuum pump 44 may also be connected directly to vacuum chamber 10 in addition to collection chamber 30 if desired.

Collection chamber 30 must be partially filled with a liquid such as oil, conventional diffusion pump oil being preferred. Other liquids could be used if desired.

If it is desired to use the apparatus of the invention as a primary pump, valve 33 and primary pump 44 could be removed, and outlet 32 would be open to the atmosphere or to any desired reservoir (not shown). Outlet 32 must be maintained in a position such that only gas would be vented therefrom, i.e. outlet 32 would be maintained above the liquid level in collection chamber 30.

If desired, the apparatus of the invention could be used in series, as both a primary pump and a secondary and/or tertiary pump, or in parallel. As many pumping stages as desired could utilize the apparatus and method of the invention as a pump.

If desired, liquid pump 26, gas-liquid separator 40, and lines 24, 34, 36, 38, and 42 may be located inside collection chamber 30 and/or venturi chamber 12.

Although the preferred embodiments of the present invention have been disclosed and described in detail above, it should be understood that the invention is in no sense limited thereby, and its scope is to be determined by that of the following claims:

What is claimed is:

1. An apparatus for obtaining sub-atmospheric pressures comprising:

a. vacuum chamber means defining a space in which a sub-atmospheric pressure may be achieved, b. venturi chamber means having a first end and a second end for reducing pressure in said vacuum chamber means, said first end of said venturi chamber means being connected to said vacuum chamber means, c. nozzle means located in said first end of said venturi chamber means for spraying fluids, d. collection chamber means connected to said second end of said venturi chamber means for receiving fluids sprayed from said nozzle means, said collection chamber means having at least two outlet means, said outlet means being spaced apart a distance sufficient to locate one of said outlet means at the bottom of said collection chamber means when said collection chamber means is rotated.

2. The apparatus of claim 1 wherein said collection chamber means has first outlet means for removing fluids from said collection chamber means and conveying said fluids to said fluid pump means, and second outlet means for removing gases from said collection chamber and conveying said gases to the atmosphere or a reservoir remote from said collection chamber means and said venturi chamber means.

3. The apparatus of claim 1 wherein said venturi chamber mean has venturi tube means therein for reducing pressure in said vacuum chamber means.

4. The apparatus of claim 1 said nozzle means is adjacent to said first end of said venturi chamber means.

5. The apparatus of claim 1 wherein said nozzle means sprays fluids droplets from said first end of said venturi chamber means toward said second end of said venturi chamber means.

6. The apparatus of claim 1 wherein primary vacuum pump means is connected to said collection chamber means.

7. The apparatus of claim 1 wherein said collection chamber means has at least two outlet means.

8. The apparatus of claim 1 wherein gas-liquid separation means is connected to said outlet means for removing gas from said liquid.

9. An apparatus for obtaining sub-atmospheric pressures comprising:

a. vacuum chamber means defining a space in which a sub-atmospheric pressure may be achieved, b. venturi tube means having a first end and a second end for reducing pressure in said vacuum chamber means, said first end of said venturi tube means being connected to said vacuum chamber means, c. nozzle means located in said first end of said venturi tube means adjacent to said first end of said venturi tube means for spraying fluids from said first end of said venturi tube means through said second end of said venturi tube means, d. collection chamber means connected to said second end of said venturi tube means for receiving fluids sprayed from said nozzle means, e. at least two outlet means connected to said collection chamber means for removing fluids from said collection chamber means spaced apart a distance sufficient to locate one of said outlet means at the bottom of said collection chamber means when said collection chamber means is rotated, and f. fluid pump means connected to one of said outlet means for pumping fluids from said outlet means to said nozzle means, said fluid pumped from said nozzle means impacting upon said collection chamber means causing partial removal of said gases from liquids in said fluids.

10. The apparatus of claim 9 wherein said collection chamber means has first outlet means for removing fluids from said collection chamber means and conveying said fluids to said liquid pump means, and second outlet means for removing gases from said collection chamber means and conveying said gases to the atmosphere or a reservoir remote from said collection chamber means and said venturi tube means.

11. The apparatus of claim 9 wherein gas-liquid separation and liquid cleaner means is connected to said outlet means for removing gas and other impurities from said liquid.

12. A method for obtaining sub-atmospheric pressures comprising:

a. connecting a venturi tube to a space in which a sub-atmospheric pressure is desired, said venturi tube having a first end and a second end for reducing pressure in said space, said first end of said venturi tube being connected to said space, b. spraying fluids from a nozzle located in said first end of said venturi tube through the second end of said venturi tube, c. collecting said fluids in a collection chamber means connected to said second end of said venturi chamber for receiving fluids sprayed from said nozzle, said collection chamber means having at least two outlet means, said outlet means spaced apart a distance sufficient to locate one of said outlet means at the bottom of said collection chamber means when said collection chamber means is rotated, d. pumping said fluids exiting from said second end of said venturi tube to said nozzle to be sprayed through said nozzle.

13. The method of claim 12 wherein gas is removed from said fluids exiting said second end of said venturi tube prior to pumping said fluids to said nozzle.

14. The method of claim 13 wherein gas is removed from said fluids exiting from said second end of said venturi tube after said fluids exiting have been pumped from said collection chamber and prior to said fluids pumped from said collection chamber having entered said nozzle.

15. The method of claim 12 wherein gas in said collection chamber is vented directly to the atmosphere.

16. The method of claim 12 wherein said space is reduced to sub-atmospheric pressure prior to connecting said venturi tube thereto.

17. The method of claim 12 wherein said venturi tube may be inverted.

18. The method of claim 12 wherein gas is sprayed from said nozzle.

* * * * *